United States Patent [19]

Yamanaka et al.

[11] Patent Number: 4,540,918

[45] Date of Patent: Sep. 10, 1985

[54] COIL DEVICE FOR IMAGE PICKUP TUBE

[75] Inventors: Junichi Yamanaka, Sagamihara; Masataka Kusaka, Yokohama, both of Japan

[73] Assignee: Tokyo Shibaura Denki Kabushiki Kaisha, Kawasaki, Japan

[21] Appl. No.: 411,004

[22] Filed: Aug. 24, 1982

[30] Foreign Application Priority Data

Aug. 27, 1981 [JP] Japan ..... 56-133364

[51] Int. Cl.[3] ..... H01J 29/56

[52] U.S. Cl. ..... 315/371

[58] Field of Search ..... 315/10, 370, 371, 310; 335/212, 213, 210; 358/217

[56] References Cited

U.S. PATENT DOCUMENTS

| | | | |
|---|---|---|---|
| 3,307,066 | 2/1967 | Shapiro et al. | 315/370 |
| 3,466,580 | 9/1969 | Bull | 335/213 |
| 3,743,983 | 7/1973 | Holman | 335/213 X |
| 3,911,321 | 10/1975 | Wardley | 315/370 X |
| 3,961,219 | 6/1976 | Bechteler et al. | 335/213 X |
| 4,191,936 | 3/1980 | Colgan, Jr. | 335/210 |
| 4,221,992 | 9/1980 | Ueda et al. | 315/10 |
| 4,290,038 | 9/1981 | Yamanaka et al. | 315/10 |
| 4,305,022 | 12/1981 | Mitamura et al. | 315/370 |

FOREIGN PATENT DOCUMENTS

| | | | |
|---|---|---|---|
| 2225172 | 12/1972 | Fed. Rep. of Germany . | |
| 2521491 | 12/1975 | Fed. Rep. of Germany . | |
| 0019915 | 8/1975 | Japan | 35/213 |
| 197806 | 6/1978 | United Kingdom | 335/213 |

OTHER PUBLICATIONS

E. W. Bull, Printed Scanning Coils, Aug. '68, Wireless World, pp. 260–262.

*Primary Examiner*—Theodore M. Blum
*Assistant Examiner*—Brian Scott Steinberger
*Attorney, Agent, or Firm*—Cushman, Darby and Cushman

[57] ABSTRACT

The invention provides a coil device having horizontal and vertical deflection coils around an outer surface of an image pickup tube to generate magnetic fields for deflecting electron beams in the horizontal and vertical directions, respectively. A correction coil is disposed between the outer surface of the image pickup tube and the horizontal deflection coil so as to correspond to the position of the vertical deflection coil. The number of turns of the correction coil is smaller than that of the vertical deflection coil. A signal for correcting scanning distortion of the electron beam caused by the deflection magnetic fields is supplied to the correction coil. The time constant of the correction coil is smaller than the period of the horizontal deflection signal. The correction coil is made of a printed circuit wiring.

6 Claims, 16 Drawing Figures

COIL DEVICE FOR IMAGE PICKUP TUBE

BACKGROUND OF THE INVENTION

The present invention relates to a color television camera (to be referred to as a color TV camera hereinafter) with a plurality of image pickup tubes and, more particularly, to a coil device arranged around the plurality of image pickup tubes to deflect electron beams generated inside the image pickup tubes.

Color TV cameras of the three-tubes type have been widely used for color television broadcast. In a color TV camera of this type, the optical image of a subject is separated into a red (R) image, a green (G) image and a blue (B) image. The separated images are respectively focused on targets of image pickup tubes for R, G and B primaries. The targets of these image pickup tubes are scanned with electron beams emitted by electron guns to obtain electrical signals corresponding to the images focused on the targets. These signals are synthesized to form a single color image.

In the three-tubes color TV camera, for synthesizing the output signals from the image pickup tubes which correspond to the primaries, registration adjustment is performed to avoid misregistration.

The registration adjustment is conventionally performed in the following manner. A registration chart is displayed on a monitor TV screen by the color TV camera and is superposed with images obtained by the R and G image pickup tubes. Horizontal and vertical deflection amplitudes, size alignments, and linearities of the R image pickup tube are adjusted to cause the R image to completely overlap the G image. Subsequently, the B and G images, obtained by the image pickup tubes, are superposed on the registration chart on the monitor TV screen. The B image is adjusted to overlap the G image in the same manner as described above. Thus, the registration adjustment, consisting of the 6 items above, is completed. In addition to the above items, two additional adjustment items such as skew adjustment and rotation adjustment may be added.

If all the items described above are checked in the registration adjustment, the adjustment cannot be completely performed. Assuming that the vertical length of the screen for raster scan is defined as 100%, even after registration adjustment, misregistration of about 0.05% occurs at the center of the screen and that of about 0.3 to 0.4% occurs in the peripheral portion. In this manner, misregistration is hard to eliminate.

In order to reduce misregistration, the following adjustment method is proposed in addition to the conventional adjustment items. Depending on the types of products, characteristics inherent to the image pickup tube do not necessarily correspond to deflection characteristics inherent to the coil assembly. Therefore, deflection distortions such as pincushion distortion and trapezoidal distortion occur due to the characteristics of the image pickup tube and the coil assembly, and a combination thereof. These distortions are considered to be a cause for misregistration. In order to correct these distortions, a method is proposed to superpose, on a vertical deflection signal, a correction signal which has a frequency component of a horizontal deflection signal as the fundamental wave. However, according to this method for correcting a distortion of an arbitrary horizontal line on the screen, the frequency component of the horizontal deflection signal is attenuated by an inductance of the vertical deflection coil. This is because the total number of turns of the vertical deflection coil is maximized to decrease power consumption by vertical deflection. In other words, the frequency of the vertical deflection signal in the NTSC system is 60 Hz. However, the number of turns of the vertical deflection coil is increased to an extent that its inductance is not important. Since the frequency of the horizontal deflection signal is higher than that of the vertical deflection signal, the current of the horizontal deflection signal can hardly flow through the vertical deflection coil. Thus, misregistration correction cannot easily be performed. The above problem will be described in detail with the accompanying drawings.

Referring to FIG. 1, assume that an image formed by an output signal from one of the image pickup tubes for primaries of the color TV camera is distorted like scanning line 10, while an image formed by an output signal of another one of the image pickup tubes for primaries is not distorted like scanning line 11. This results in misregistration. In order to correct the distortion to obtain a nondistorted image like the scanning line 11, the vertical deflection signal waveform shown in FIG. 2 must be corrected. FIG. 3 shows an enlarged part 20 of the vertical deflection signal waveform shown in FIG. 2. A broken line 30 indicates the signal waveform without correction, while a solid line 31 indicates the signal waveform on which a correction signal, including the horizontal deflection signal as the fundamental wave, is added. With the corrected signal, the distortion like the scanning line 10 shown in FIG. 1 is relatively easily eliminated.

However, a distortion of a scanning line 40 shown in FIG. 4 cannot be easily corrected. In order to correct the scanning line 40, a corrected vertical deflection signal waveform 51 is required as opposed to a nondistorted vertical deflection signal waveform 50. Further, since the vertical deflection coil has a large inductance, it functions as an integrating circuit for integrating the correction signal which has the vertical deflection signal as the fundamental wave. The waveform of a current flowing through the vertical deflection coil is an integrated waveform of the waveform of a voltage applied thereto. Referring to FIG. 5, the waveform of the correction signal alone is the current waveform 60 shown in FIG. 6A. However, in order to obtain such a current waveform in the vertical deflection coil, a voltage waveform 61, shown in FIG. 6B, must be applied to the vertical deflection coil. The waveform 61 is a differential waveform of the waveform 60. Therefore, the waveform 61 has a pulse of high level and narrow width in horizontal flyback period 62, and the pulsed portion is outside of the linear region of the vertical deflection circuit. Even if the above problem is eliminated, the vertical deflection coil has a large inductance and has narrow-band characteristics with respect to the horizontal deflection signal and its harmonic. For this reason, the frequency characteristic for the harmonic component is more damped than that for the horizontal deflection signal. Even if the ideal differential voltage waveform 61 of the current waveform 60 is applied across the vertical deflection coil, an integrated current waveform with attenuated harmonic component is obtained in practice. The current with the waveform indicated by the broken line 63 flows through the vertical deflection coil. As indicated by the broken line in FIG. 4, a terminal end 42 of the scanning line is properly corrected. However, an initial end 41 of the scanning line is distorted.

It is thus understood that the general deflection distortion shown in FIG. 4 cannot be easily corrected. If more complicated distortions are involved, a voltage of a more complex waveform must be applied across the vertical deflection coil. As a result, correction cannot be performed in practice, due to the frequency characteristic of the vertical deflection coil.

The above method has a further drawback; the current waveform is the integrated waveform of the voltage waveform. An integrated value between the voltage waveforms 64 and 65 shown in FIG. 6B must be zero. However, the pulsed portion cannot be properly integrated due to the linear region of the vertical deflection circuit and the frequency characteristics of the vertical deflection coil. In practice, the current waveform corresponds to the integrated waveform in which the integration value between the voltage waveforms 64 and 65 is not 0. In other words, a DC magnetic field is applied to the vertical deflection magnetic field, so that the image is vertically deflected. If misregistration occurs in this case, the adjustment of deflection distortions is complicated. Thus, misregistration is not desirable in this case.

SUMMARY OF THE INVENTION

It is, therefore, an object of the present invention to provide a coil device with a correction coil for high precision misregistration correction.

It is another object of the present invention to provide a coil device which is capable of correcting deflection distortions due to vertical and horizontal deflection magnetic fields.

It is still another object of the present invention to provide a coil device which can be readily adopted for a conventional coil assembly without considering a mounting position thereof.

A coil device of an image pickup tube has: horizontal and vertical deflection coils which are disposed on the outer surface of an image pickup tube envelope, and correction coils which have a smaller number of turns than the vertical and horizontal deflection coils to correct deflection distortions caused by the horizontal and vertical deflection coils. The correction coils are disposed in correspondence to the vertical deflection coils or horizontal deflection coils and have a time constant smaller than the period of the horizontal deflection signal. The correction coils are formed by printed circuit wirings and are disposed between the outer surface of the image pickup tube envelope and the deflection coils. A signal is supplied to the correction coils to correct the deflection distortion.

DETAILED DESCRIPTION OF THE PREFERRED EMBODIMENTS

Figure 7:
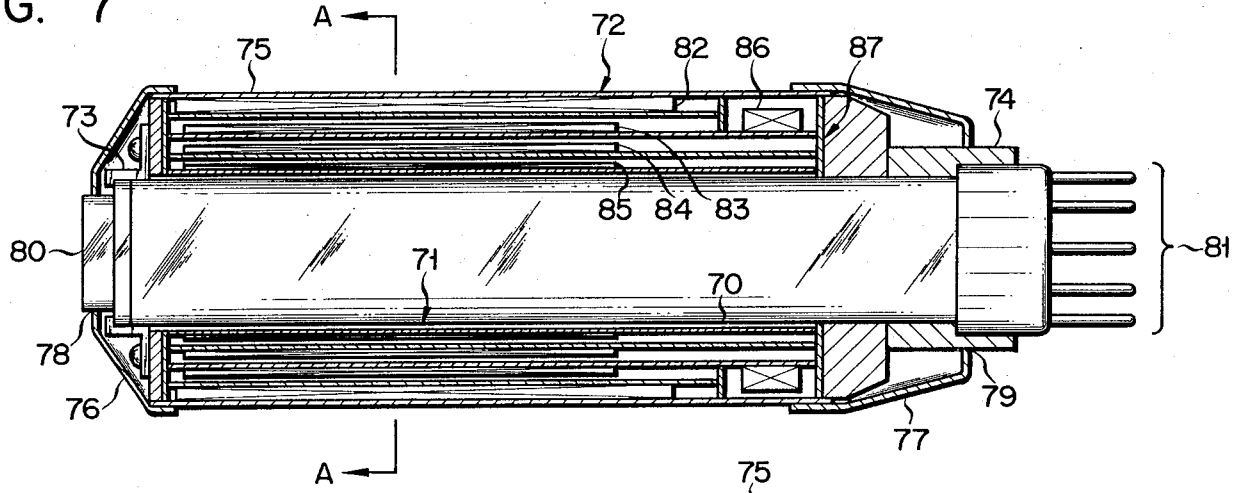
FIG. 7 is a side sectional view of a coil device for an image pickup tube according to one embodiment of the present invention.

Referring to FIG. 7, an image pickup tube 71 comprises a vidicon or the like. The image pickup tube 71 has a target (not shown) which forms an optical image thereon and a hermetic glass envelope 70 which supports the target. An electron gun (not shown) is disposed inside the glass envelope 70. The target is scanned with the electron beams generated from the electron gun. An electric signal corresponding to the optical image is generated by the target.

A coil assembly 72 is arranged around the glass envelope 70 of the image pickup tube 71. The coil assembly 72 is fixed on the image pickup tube 71 by press members 73 and 74. The image pickup tube 71 with the coil assembly 72 is housed in a shield tube 75. Front and rear end caps 76 and 77 are mounted on the two ends faces of the shield tube 75. Through holes 78 and 79 are formed in the front and rear end caps 76 and 77. A faceplate 80 of the image pickup tube 71 and external connection terminals 81 respectively extend through the through holes 78 and 79.

Figure 8:
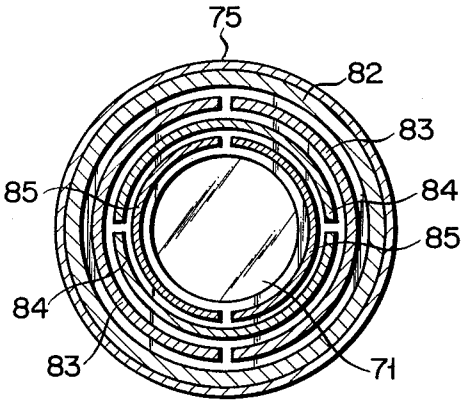
FIG. 8 is a sectional view along the line A—A in FIG. 7.

The coil assembly 72 comprises a focusing coil 82, vertical deflection coils 83, horizontal deflection coils 84, correction coils 85, an alignment coil 86 and a bobbin 87. These coils 82, 83, 84, 85, and 86 are arranged on the bobbin 86 which allows the coils 82, 83, 84, 85, and 86 to be spaced apart from each other at predetermined intervals and which also keeps the predetermined intervals between the image pickup tube 71 and the coils 82, 83, 84, 85 and 86. The horizontal deflection coils 84 and the vertical deflection coils 83 respectively generate horizontal and vertical deflection magnetic fields to horizontally and vertically deflect the electron beams generated by the electron gun of the image pickup tube 71. The magnetic fluxes generated by the horizontal and vertical deflection coils 84 and 83 are perpendicular to each other. The vertical deflection coils 83 which respectively have semicircular shapes are shifted by 180° from the horizontal deflection coils 84 which respectively have semicircular shapes, as shown in FIG. 8. It is considered that there is substantially no interference between the two magnetic fields. Note that the bobbin 87 is not shown in FIG. 8. The focusing coil 82 is used to converge the electron beams and the alignment coil 86 generates a magnetic field for aligning the electron beams.

Figure 15:
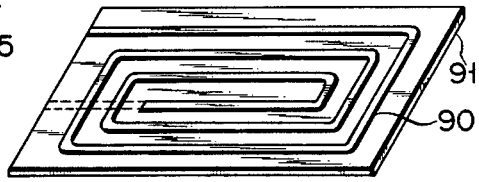
FIG. 15 is a perspective view showing the overall arrangement of the correction coil.

The correction coils 85 are the principle part of the present invention. The correction coil 85 which has a semicircular shape is wired in the same direction as the vertical deflection coil 83, as shown in FIG. 8. The correction coils 85 are arranged to generate the magnetic flux in the same direction as the vertical deflection magnetic flux. The number of turns of the correction coil 85 is smaller than that of the vertical deflection coil 83. The correction coil 85 comprises a conductive layer 90 which is printed on a flexible substrate 91, as shown in FIG. 15. The correction coil 85 is disposed between the vertical deflection 84 and the image pickup tube 71 as shown in FIG. 7 and is positioned in correspondence with the vertical deflection coil 83, as shown in FIG. 8. The mounting position of the correction coil 85 is not limited since it is formed as the printed circuit wiring shown in FIG. 15. Therefore, the correction coil can be readily mounted in the conventional coil assembly. Further, since the correction coil 85 is disposed nearest the outer surface of the image pickup tube 71, the magnetic field generated by the correction coils 85 may be effectively superposed on the magnetic field generated by the vertical deflection coils 83.

As described above, the number of turns of the vertical deflection coil 83 is greater than that of the correction coil 85 in order to achieve low power consumption. The vertical deflection coil 83 has, for example, 160 turns, a winding resistance of 200 ohms, and an inductance of 30 mH. The above specifications of the vertical deflection coil 83 represent only one example, but in most examples there will be no variation.

A time constant tV of the vertical deflection coil is given by the following equation:

$$tV = LV/RV = (30 \times 10^{-3})/200 = 1.5 \times 10^{-4}\ \text{sec} = 150\ (\mu\text{sec})$$

where LV is the inductance of the coil, and RV is the winding resistance.

The time constant of the vertical deflection coil is considerably smaller than the period (1/60 sec) of the vertical deflection signal, but is larger than the period of the horizontal deflection signal. (In the NTSC system, since the horizontal deflection pulse frequency is about 15.75 kHz, its period is about 63.5 μsec.)

The deflection current flowing through the vertical deflection coil with the above specifications is about 30 to 40 mA (peak-to-peak value). The misregistration is represented about 0.05% at the center of the conventional screen and about 0.3 to 0.4% in the peripheral portion thereof. Thus, the correction corresponding to 0.4% or more must be performed by the misregistration adjustment. With a given allowance, 0.8 to 1% correction must be performed for misregistration adjustment. This amount of correction is generally determined by R and B image signals with respect to the G image signal generated by the image pickup tube. Therefore, the correction range must cover the negative and positive values. That is, the amount of correction is in a range of ±0.8 to ±1%. (The allowance of deflection distortion by the image pickup tube, which produces the G image signal as the reference signal, is generally 0.5 to 1%. The deflection distortion by the image pickup tube for the G image may be decreased using the correction function of misregistration of the present invention. In this case, since a strict allowance of the deflection distortion is not required, the amount of correction may be in a range of ±0.8 to ±1%. If this amount is in a range of ±1.0 to ±1.5%, the deflection distortion by the image pickup tube for the G image as the reference is greatly decreased.)

A correction method for misregistration will be described when the amount of correction is ±1.0%.

The number of turns of the correction coil 85 is significantly smaller that that of the vertical deflection coil 83. Assume that the number of turns of the correction coil 85 is one-tenth that of the vertical deflection coil 83, and that the vertical deflection coil and the correction coil are made of the same material. A wiring resistance of the correction coil 85 is one-tenth of 200 ohms, that is, 20 ohms; an inductance thereof is $(1/10)^2$ of 30 mH, that is, 300 (μH). Thus, a time constant is given as follows:

$$t = L/R = (300 \times 10^{-6})/20 = 15 \times 10^{-6}\ \text{sec} = 15\ (\mu\text{sec})$$

Alternatively, if the number of turns of the correction coil is one-twentieth that of the vertical deflection coil, a wiring resistance of the correction coil is 10 ohms, an inductance is 75 μH $(=1/20)^2$ of 30 mH. Thus, a time constant is given as follows:

$$t = (75 \times 10^{-6})/10 = 7.5 \times 10^{-6}\ \text{sec} = 7.5\ \mu\text{sec}$$

In order to further decrease the time constant of the correction coil, a resistor must be connected in series with the correction coil 85. Now assume that the combined resistance between the wiring resistance of the correction coil 85 and the resistance of the resistor connected in series therewith is 10 times the wiring resistance of the correction coil 85. The time constants become 1/10, respectively, 1.5 μsec and 0.75 μsec. The time constants become 1/40 to 1/80 of the period (63.5 μsec) of the horizontal deflection signal. If the resistance of a resistor connected in series with the correction coil is decreased, the time constant of the correction coil is further decreased. Further, since the correction coil 85 is driven by a current source circuit, a current flowing through the correction coil 85 may not be integrated since the current source has a high output impedance.

Any other difference between the vertical deflection coil 83 and the correction coil 85 is represented by a self resonant frequency. The self resonant frequency of the vertical deflection coil is generally confirmed in practice to be 5 to 10 times that of the horizontal deflection coil. In a condition in which the coil assembly is mounted in the image pickup tube, the horizontal deflection signal leaks slightly into the vertical deflection coil to cause ringing so that ringing is superposed on the vertical video signal. The self resonant frequency of the vertical deflection coil can be then determined by a frequency at which ringing occurs. The ringing can be eliminated by connecting a damping resistor parallel to the vertical deflection coil.

The inductance of the correction coil 85 is $(1/10)^2$ to $(1/20)^2$ of that of the vertical deflection coil 83. The self resonant frequency of the correction coil 85 is 10 to 20 times that of the vertical deflection coil 83 even if the stray capacitance of the correction coil 85 is assumed to be the same as that of the vertical deflection coil 83. The stray capacitance of the coil is generally complex and is decreased if the number of turns is decreased. The self resonant frequency is then increased. The frequency characteristics, defined by the self resonant frequency of the correction coil 85, are dozens of times that of the vertical deflection coil 83.

Figure 1:
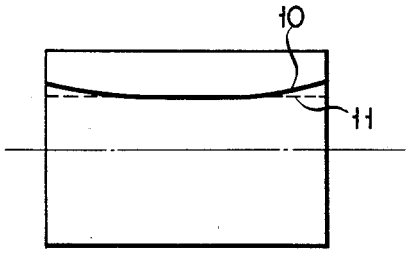
FIG. 1 is a view showing one example of misregistration.
Figure 2:
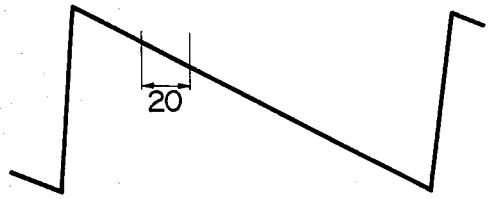
FIG. 2 is a view showing a vertical deflection signal waveform.
Figure 3:
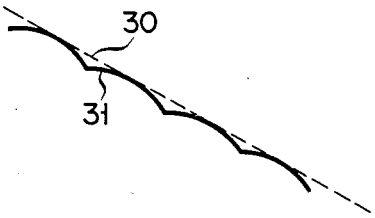
FIG. 3 is an enlarged view of part of the vertical deflection signal waveform shown in FIG. 2 to explain the correction thereof.
Figure 4:
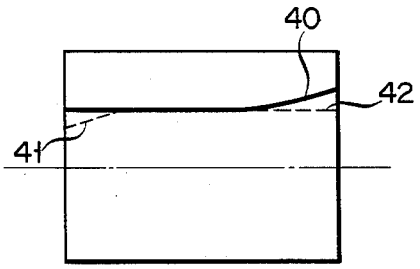
FIG. 4 is a view showing another example of misregistration.
Figure 5:
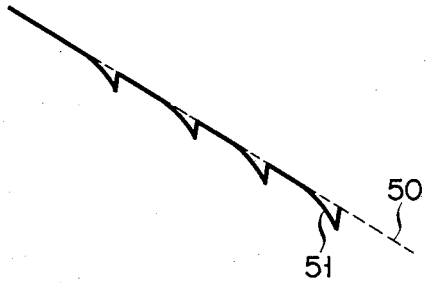
FIG. 5 is an enlarged view of part of the waveform in FIG. 4 to explain the correction thereof.
Figure 6A:
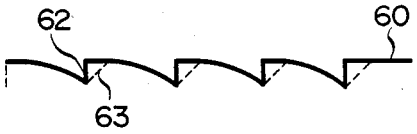
FIGS. 6A and 6B are views showing signal waveforms for producing the waveform shown in FIG. 5.
Figure 6B:
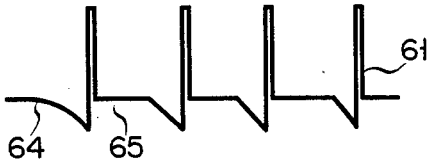

As is apparent from the above description, a misregistration correction signal including the horizontal deflection signal and its harmonic component can be readily applied across the correction coil 85. Further, the differential voltage generated by the inductance component of the correction coil 85 is extremely small compared with when the correction signal is applied across the vertical deflection coil. The differential voltage is considerably lower than the voltage across the two ends of the combined resistor of the internal resistance of the correction coil 85 and the resistance of the resistor connected in series with the correction coil. The voltage waveform of a voltage source applied to the correction coil 85 and the resistor connected in series therewith, can be considered to be a voltage waveform of the correction coil 85. In other words, a current (e.g., a current waveform 60 in FIG. 6A) for generating a magnetic field to correct misregistration can flow through the correction coil 85. In this case, since the vertical deflection magnetic field is generated by the vertical deflection coil 83, the correction coil 85 generates a magnetic flux only to correct misregistration. Further, since the frequency of the output signal from the correction coil 85 is considerably higher than that of the horizontal deflection signal, it is possible to generate a magnetic field which produces a more complex current waveform than the magnetic field which forms the current waveform 60 shown in FIG. 6A. This means that a more complex deflection distortion can be eliminated and that highly precise registration adjustment can be achieved.

The correction coil 85, according to the present invention, has advantages in that the magnetic field generated only for misregistration adjustment can be generated independently of the magnetic field of the vertical deflection coil 83, and that misalignment of vertical deflection which is caused by the misregistration correction signal does not occur since the integration effect due to the coil is negligible.

If the number of turns of the correction coil 85 is one-tenth that of the vertical deflection coil 83, a current flowing through the correction coil 85 to perform ±1.0% misregistration correction is 10 times ±1% of the vertical deflection current, that is, 35 10% thereof. According to the specifications of the vertical deflection coil 83, the deflection current is 30 to 40 mA (peak-to-peak value). Therefore, the correction current is ±3 to ±4 mA.

Figure 9:
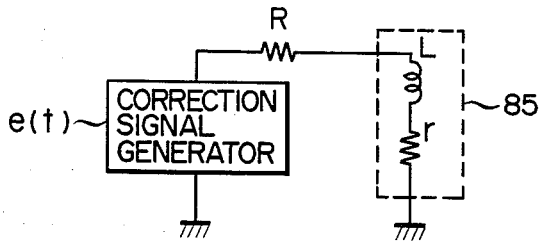
FIGS. 9 to 11 are block diagrams of excitation circuits of the correction coil shown in FIG. 7, respectively.
Figure 10:
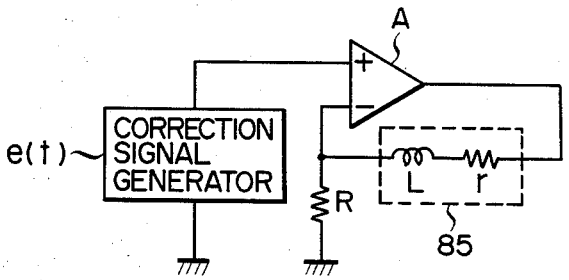
Figure 11:
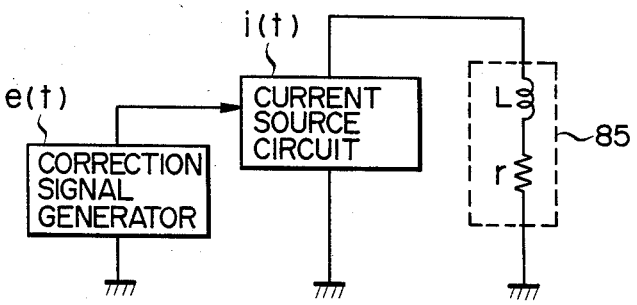

FIGS. 9 to 11 respectively show excitation circuits of the correction coil 85. A misregistration correction signal generator e(t) corresponds to a voltage source circuit. In a pair inside the broken rectangle, reference symbols L and R denote the inductance and the winding resistance of the correction coil 85, respectively.

Referring to FIG. 9, an output signal from the correction signal generator e(t) is supplied to the correction coil 85 through a resistor R.

Referring to FIG. 10, the output signal from the correction signal generator e(t) is supplied to a noninverting input end of an operational amplifier A. An output signal from the operational amplifier A is supplied to an inverting input end thereof through the correction coil 85, and is grounded through the resistor R. In this case, a current with a waveform similar to that of the output signal from the correction signal generator e(t) flows through the correction coil 85.

Referring to FIG. 11, the output signal from the correction signal generator e(t) is supplied to a current source circuit i(t). The current source circuit i(t) produces a signal which has a waveform similar to that of the output signal from the correction signal generator e(t). This signal is supplied to the correction coil 85 which is then excited.

Figure 12:
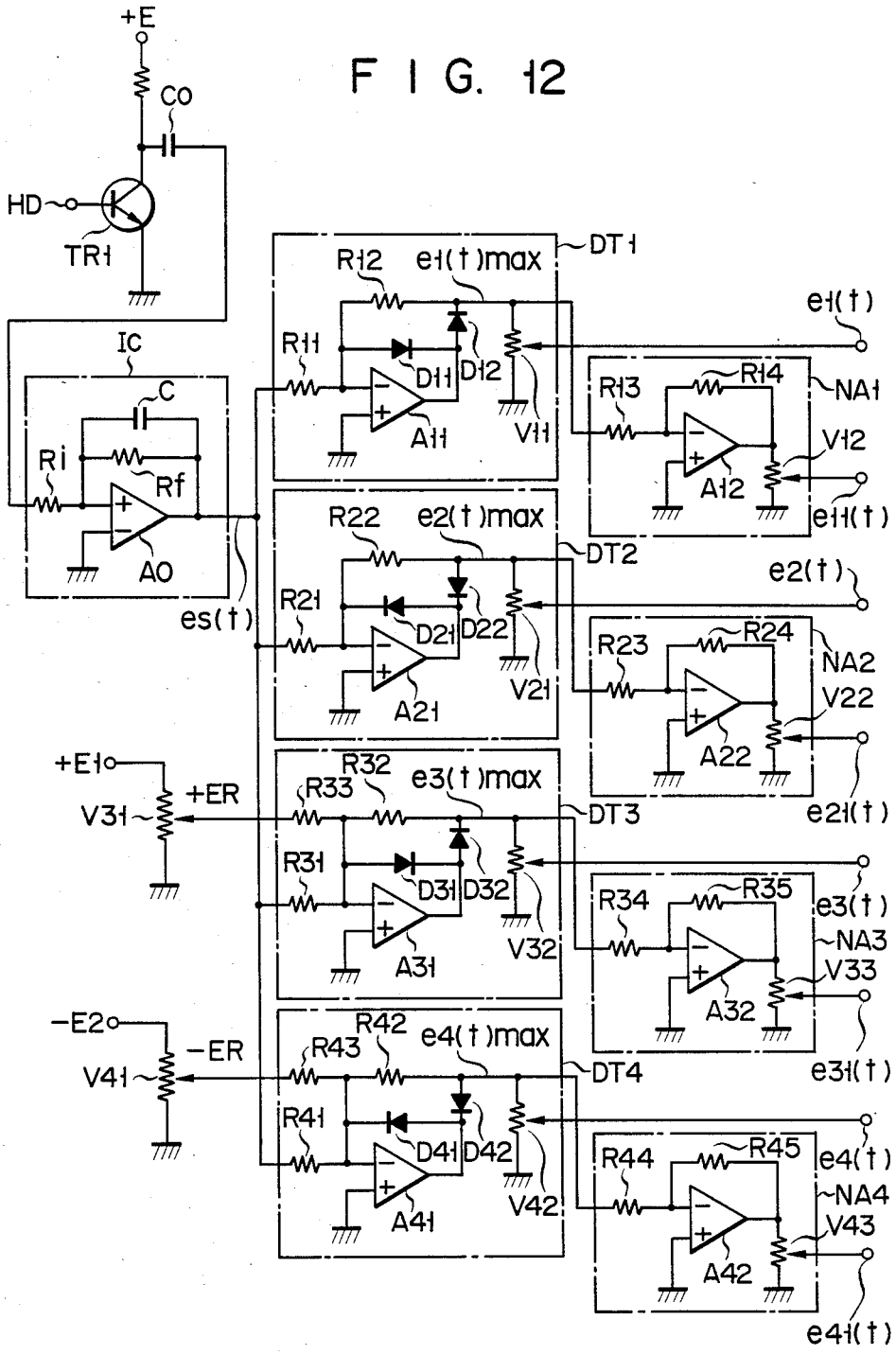
FIG. 12 is a circuit diagram of one example of a correction signal source of the excitation circuits shown in FIGS. 9 to 11.
Figure 13:
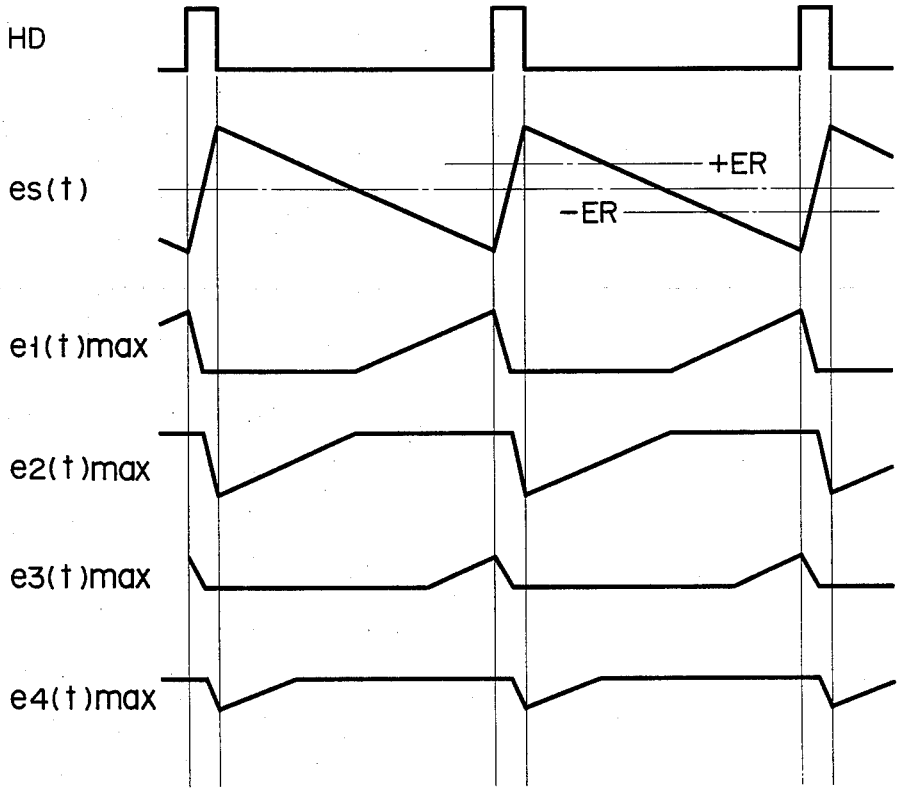
FIG. 13 shows signal waveforms at the parts of the correction signal source in FIG. 11.

FIG. 12 is a circuit diagram of the correction signal generator e(t). A horizontal drive pulse HD with a waveform shown in FIG. 13 is applied to the base of a transistor TR1 to switch it. An output signal from the transistor TR1 is supplied to a known integrator circuit Ic through a DC current cutoff capacitor C0. The integrator circuit Ic comprises an operational amplifier A0 (to be referred to as an OP Amp. hereinafter), resistors Ri and Rf, and a capacitor C. The resistor Rf is arranged to stabilize the output signal from the OP Amp. A0 in a DC manner. A time constant defined by the capacitor C and the resistor Ri is sufficiently greater than the period of the horizontal drive pulse HD. An output signal es(t) from the integrator circuit Ic is shown in FIG. 13. Since the capacitor C0 cuts off the DC signal and does not supply it to the input of the OP Amp. OA, the average value of the output signal es(t) is set at 0 V, and an instantaneous value at the center thereof is 0 V. The output signal es(t) is supplied to known linear detectors DT1, DT2, DT3 and DT4, respectively. The linear detector DT1 comprises an OP Amp. A11, diodes D11 and D12, resistors R11 and R12, and a variable resistor V11, while the linear detector DT2 comprises an OP Amp. A21, diodes D21 and D22, resistors R21 and R22, and a variable resistor V21. The output signal es(t) is supplied to inverting input ends of the OP Amps. A11 and A21, respectively, and noninverting input ends thereof, receive a reference voltage (ground potential) for determining the positive or negative input. The OP Amps. A11 and A21 produce output signals e1(t)max and e2(t)max of the waveforms respectively shown in FIG. 13. The output signals e1(t)max and e2(t)max respectively correspond to the positive and negative components of the output signals es(t). The linear detector circuit DT3 comprises an OP Amp. A31, diodes D31 and D32, resistors R31, R32 and R33 and variable resistors V31 and V32, while the linear detector DT4 comprises an OP Amp. A41, diodes D41 and D42, resistors R41, R42 and R43, and variable resistors V41 and V42. The operation of the linear detector circuits DT3 and DT4 is substantially the same as that of the linear detector circuits DT1 and DT2 except that the positive and negative components with respect to the ground potential are determined by the variable resistors V31 and V41, respectively. If output voltages of the variable resistors V31 and V41 are respectively defined as +ER and −ER, the waveforms of these voltages are as represented by es(t) of FIG. 13. The output signal es(t) supplied to the inverting input ends of the OP Amps. A31 and A41 is inverted in accordance with the voltages +ER and −ER. Therefore, signals e3(t)max and e4(t-)max of the waveforms shown in FIG. 13 are produced by the OP Amps. A31 and A41. The output signals e1(t)max to e4(t)max are respectively generated by the OP Amps. A11 to A41 are respectively adjusted to predetermined levels by the variable resistors V11, V21, V32 and V42 and are produced as e1(t) to e4(t). The output signals e1(t)max to e4(t)max from the OP Amp. A11 to A41 are also supplied to inverting amplifier circuits NA1 to NA4, respectively. The inverting amplifier circuit NA1 comprises an OP Amp. A12, resistors R13 and R14, and a variable resistor V12; the inverter amplifier circuit NA2 comprises an OP Amp. A22, resistors R23 and R24 and a variable resistor V22; the inverting amplifier circuit NA3 comprises an OP Amp. A32, resistors R43 and R35 and a variable resistor V33; and the inverting amplifier circuit NA4 comprises an OP Amp. A42, resistors R44 and R45 and a variable resistor V43. Output signals e11(t) to e41(t) are respectively generated by the inverter amplifier circuits NA1 to NA4. These output signals are inverted output signals e1(t)max to e4(t)max with predetermined levels.

The output signals e1(t) and e11(t) are used as misregistration correction signals for the right half of the screen, as is apparent from FIG. 13. The right half of one horizontal sync pulse on the time base corresponds to the right half of the screen in the standard deflection system.)

The output signals e2(t) and e21(t) are used to correct misregistration on the left half of the screen; the output signals e3(t) and e31(t) are used to correct misregistration on the right quarter of the screen; and the output signals e4(t) and e41(t) are used to correct misregistration on the left quarter of the screen. When a plurality of these signals are synthesized to produce a composite signal, a complex misregistration can be corrected with the composite signal.

A coil device according to another embodiment of the present invention will be described below.

In the first embodiment, only the misregistration caused by the vertical deflection magnetic field has been corrected. A misregistration caused by the horizontal deflection magnetic field can also be corrected. In this case, since the inductance of the horizontal deflection coil is smaller than that of the vertical deflection coil, the integration effect by the horizontal deflection coil is not a substantial problem. However, since the DC current does not flow through the horizontal deflection circuit connected to the horizontal deflection coil, care must be taken so that the operation point of the deflection magnetic field does not deviate due to the correction signals. In order to achieve this, correction coils must be arranged in the same manner as in the first embodiment, and misregistration correction signals must be supplied to these correction coils.

Figure 14:
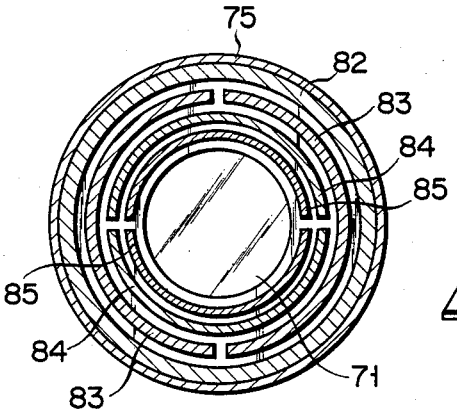
FIG. 14 is a sectional view of a coil device according to another embodiment of the present invention.

FIG. 14 shows an example of correction of misregistration caused by the horizontal deflection magnetic field. In this case, a correction coil 85 is disposed in correspondence with the horizontal deflection coil 84. If the correction coil 85 is arranged in the same manner as in the coil of the first embodiment, it has wide frequency characteristics, allowing complex misregistration correction with high precision.

As described above, according to the present invention, the correction coils are disposed independently of the vertical and horizontal deflection coils. With the correction coils, misregistration by a magnetic field generated thereby can be corrected independently of the vertical and horizontal deflection magnetic fields. A current for the horizontal deflection signal and its harmonic component can sufficiently flow through the correction coil to adjust a complex deflection distortion and misregistration caused thereby. Therefore, highly precise registration adjustment can be performed. Further, since the magnetic field generated by the correction coil does not affect the deflection magnetic field generated by the horizontal and vertical deflection coils, the deflection deviation in the vertical and horizontal directions does not occur. The correction coils can be disposed in correspondence with the vertical deflection coils or the horizontal deflection coils, so that misregistration, caused by the deflection distortions by the vertical and horizontal deflection magnetic fields, can be precisely corrected. Further, since the correction coil is made of a printed circuit wiring, the mounting position of the correction coil is not limited, so that the correction coil according to the present invention can be easily mounted in the conventional coil assembly.

We claim:

1. An image pickup device for a television camera comprising:

an image pickup tube having a target and means for scanning the target with an electron beam and producing an electric signal corresponding to an image formed on said target;

a vertical deflection coil, surrounding said tube, for generating a vertical deflection magnetic field causing said electron beam to scan the target in the vertical direction;

a horizontal deflection coil, arranged between the image pickup tube and said vertical deflection coil and surrounding said tube for generating a horizontal deflection magnetic field causing said electron beam to scan the target in the horizontal direction;

a correction coil arranged between the tube and the horizontal deflection coil and surrounding said image pickup tube for generating a correction magnetic field in the same direction as said vertical deflection magnetic field, said correction magnetic field being generated in part of said vertical deflection magnetic field; and a circuit for generating a correction signal having a period shorter than that of a horizontal drive pulse, the correction signal being supplied to said correction coil.

2. An image device for a television camera comprising:

an image pickup tube having a target and means for scanning the target with an electron beam and producing an electric signal corresponding to an image formed on said target;

a horizontal deflection coil, surrounding said image pickup tube, for generating a horizontal deflection magnetic field causing said electron beam to scan the target in the horizontal direction;

a vertical deflection coil, arranged between the tube and the horizontal deflection coil and surrounding the periphery of said image pickup tube, for generating a vertical deflection magnetic field causing said electron beam to scan the target in the vertical direction; and a correction coil arranged between said tube and said vertical deflection coil and surrounding said tube for generating a correction magnetic field in the same direction as said horizontal deflection magnetic field, said correction magnetic field being generated in part of said horizontal deflection magnetic field; and a circuit for generating a correction signal having a period shorter than that of a horizontal drive pulse, the correction signal being supplied to said correction coil.

3. An arrangement according to claim 1, wherein said correction signal generating circuit comprises: a circuit for integrating a horizontal drive pulse signal; a linear direction circuit for generating a correction signal having a period shorter than that of said integrated signal; and a circuit for inverting said correction signal.

4. An arrangement according to claim 2, wherein said correction signal generating circuit comprises:

a circuit for integrating a horizontal drive pulse signal;

a linear direction circuit for generating a correction signal having a period shorter than that of said integrated signal; and a circuit for inverting said correction signal.

5. An arrangement according to claim 1 or 2, wherein said correction coil comprises a conductive layer which is printed on a flexible substrate.

6. An arrangement according to claim 1 or 2, further comprising a circuit for generating a correction signal which is supplied to said correction coil.

* * * * *